United States Patent [19]

Noguchi et al.

[11] 4,080,283

[45] Mar. 21, 1978

[54] PROCESS FOR CONTINUOUS PRODUCTION OF PITCH

[75] Inventors: Kosaku Noguchi, Tokyo; Kiyoharu Yoshimura, Izumi; Honami Tanaki, Isumi; Reijiro Nishiyama, Izumi; Akio Mimura, Izumi; Jousuke Sato, Tanashi; Kiyohiko Koizumi, Tokyo, all of Japan

[73] Assignee: Koa Oil Company, Ltd., Tokyo, Japan

[21] Appl. No.: 791,681

[22] Filed: Apr. 28, 1977

[30] Foreign Application Priority Data

May 4, 1976 Japan ..... 51-51080

[51] Int. Cl.[2] ..... C10C 1/00; C10G 9/00

[52] U.S. Cl. ..... 208/40; 208/22; 208/131

[58] Field of Search ..... 208/40, 22, 49, 50, 208/67, 72, 85, 106, 131

[56] References Cited

U.S. PATENT DOCUMENTS

| | | | |
|---|---|---|---|
| 2,752,290 | 6/1956 | Beattie | 208/40 |
| 2,756,186 | 7/1956 | Owen et al. | 208/40 |
| 3,140,248 | 7/1964 | Bell et al. | 208/40 |
| 3,318,801 | 5/1967 | Alexander et al. | 208/40 |
| 3,928,170 | 12/1975 | Takahashi et al. | 208/40 |
| 4,014,781 | 3/1977 | Ueda | 208/40 |

*Primary Examiner*—Edward J. Meros

[57] ABSTRACT

Pitch is produced continuously by heat treating a heavy hydrocarbon oil at a temperature of 350° to 500° C successively in two or more reactors connected in series, outlet to inlet, recirculating, at the same time, one portion of the liquid output substance from at least one reactor into that reactor, and introducing the output substance (molten pitch) of the final reactor into an after-treatment chamber of duct shape with an inactive atmosphere sealed therewithin thereby to cool the output substance.

14 Claims, 1 Drawing Figure

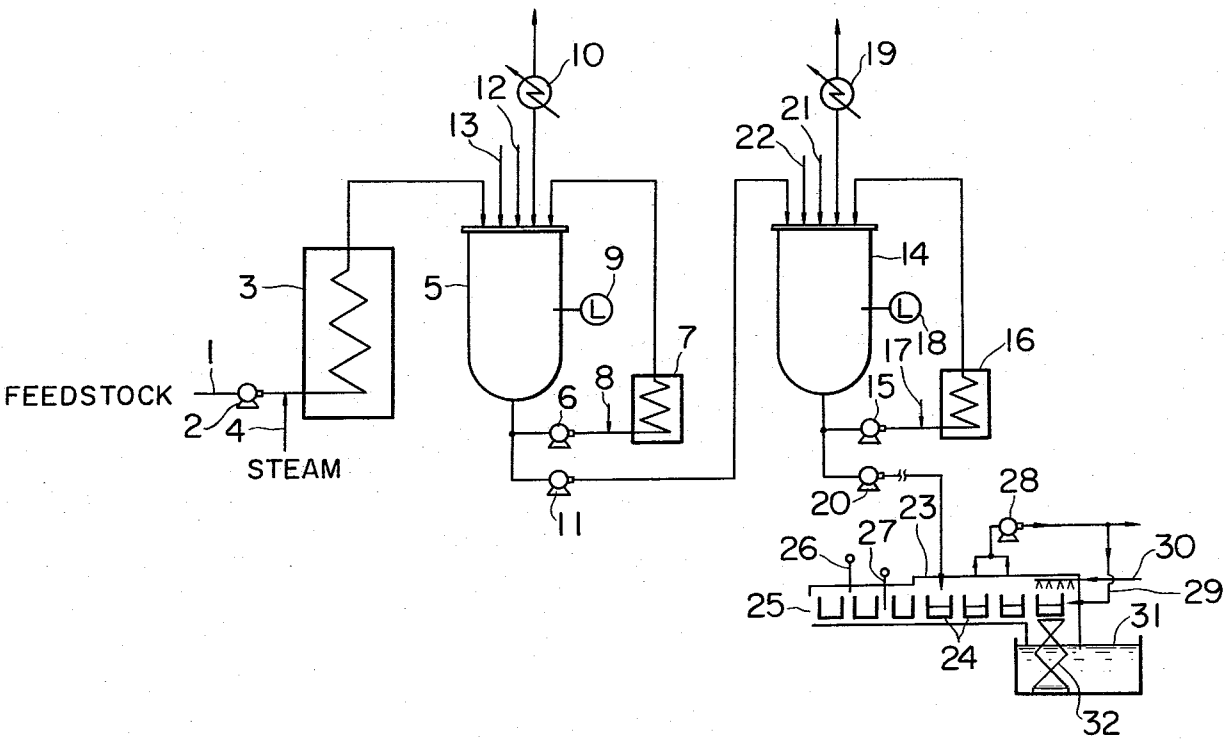
FEEDSTOCK
STEAM
1
2
3
4
5
6
7
8
9
10
11
12
13
14
15
16
17
18
19
20
21
22
23
24
25
26
27
28
29
30
31
32

PROCESS FOR CONTINUOUS PRODUCTION OF PITCH

BACKGROUND OF THE INVENTION

This invention relates generally to the production of pitches and more particularly to a process for continuous production of a pitch by a liquid-phase heating treatment of a heavy hydrocarbon oil, in which the liquid-phase heating treatment is carried out successively in a plurality of reactors connected in series, at least one of the reactors having a recirculation line.

The procedure of subjecting a heavy hydrocarbon oil derived from petroleum or coal (hereinafter referred to simply as "heavy oil ") to a high temperature for a specific time thereby to cause thermal cracking and polymerization and condensation of the hydrocarbons, to distill out gases and light oil fractions, and, at the same time, to produce as a residue a pitch, which, in general, is a black solid at room temperature, is known.

The character of this pitch differs with conditions such as the kind of the starting material oil and the process temperature and time. It is known that pitches which have been subjected to heat treatment at high temperature over a long period have a high content of components insoluble in solvents and become pitches of low content of volatile matter and, at the same time, high softening point. It is also a matter of common knowledge that pitches produced in this manner are used in a wide range of applications, a few examples thereof being as a binder for the manufacture of formed carbon products such as carbon electrodes and formed coke, as an oil adsorbent, as a starting material for various carbon products, and as a bituminous additive for various materials such as plastics and concrete.

Accordingly, various processes for producing these useful pitches with heavy oil as starting material have been and are being proposed. Among these known processes, there are two principal types. One of these types is a vapor-phase process in which heavy oil is subjected to a vapor-phase contact process for a short time together with a heating medium such as steam at a high temperature of the order of 800° C to 2,000° C (as disclosed, for example, in Japanese Patent Publication No. 27844/1975 and Patent Laid Open No. 21003/1975). The other type is a liquid-phase process in which heavy oil is heat treated over a long time at a relatively low temperature of the order of 300° C to 500° C (as disclosed, for example, in Japanese Patent Publication 43103/1974 and Patent Publication 22422/1972). Also known are combinations of these two types (as disclosed, for example, in Japanese Patent Publication 2417/1971).

Of these known processes, the vapor-phase process can be said to be intrinsically suited for continuous production of pitch, but it entails difficult problems in reduction to an industrial-scale operation such as severity of conditions of contact between the starting material heavy oil and the heating medium, conditions relating to the nozzle construction and arrangement, and conditions of heating. On the other hand, the liquid-phase process has the intrinsic advantage of being carried out under mild reaction conditions. Furthermore, since the liquid-phase process produces pitches of characteristics differing from those resulting from the vapor-phase process, there is a necessity of developing this process independently of the vapor-phase process. Accordingly, various proposals as cited above are being made.

However, almost all of the processes proposed heretofore for producing pitches by the liquid-phase process are of the batch type, and there have been few attempts to develop a continuous process. The reason for this evidently is that it is necessary to hold the heavy oil at the reaction temperature for a relatively long time in the case of a liquid-phase process, and in order to meet this requirement, a reaction process of the batch vessel type is inherently better suited. In addition, as the heating and transformation of the starting material oil into a heavier oil progresses, coking occurs simultaneously, and it becomes difficult to avoid adhesion of carbonaceous materials to the reaction vessel wall parts and clogging of the outlet piping.

For example, in the delayed coking process, a heavy oil of the same character as that in the production of pitch is used as a starting material, which is treated for a long time at a temperature in a similar range, thereby to produce coke. As is apparent from this, also, the occurrence of coking is an inevitable problem in the production of pitch. In the delayed coking process, incidently, as a method of recovering the formed coke, the reactor is opened, and complicated steps such as boring and cutting of the solidified coke are resorted to.

This coking and adhesion of formed carbonaceous materials to the wall and other parts of the reactor, although not desirable because of deviations in the character of the product pitch, do not constitute a fatal obstacle to the operation in a batch process. In a continuous process, however, they are fatal, rendering the operation practically impossible.

With the aim of overcoming the difficulties caused by this partial coking of heavy oil, various methods have been proposed. One method (e.g., as disclosed in the specification of Japanese Patent Laid Open No. 59102/1973), although it relates to a batch process, comprises dividing the reaction into two stages, carrying out the first-stage reaction with respect to heavy oil with which solid carbon particles have been admixed, causing carbonaceous substance formed to adhere to the carbon particles, subjecting these solid carbon components to solid-liquid separation thereby to separate an oily substance, which is then subjected to the second-stage heating and transformation into a heavier oil or pitch.

However, a method of this character involving solid-liquid separation requires a complicated operation as described above and, in view of the restriction of the operational conditions by the properties of the coke formed at the same time, cannot be said to be always suitable for continuous and, at the same time, economical production of pitch having a broad range of properties.

SUMMARY OF THE INVENTION

Accordingly, it is an object of this invention to provide a process for continuous production of pitch in which the above described difficulties encountered in the prior art are overcome, and by which pitch having a wide range of properties can be produced economically and, moreover, in a high yield from heavy oil by a liquid-phase reaction.

As a result of our studies, we have found that the partial coking of the heavy oil and the adhering of the carbonaceous substances thus formed onto the reactor wall and the outlet part are due principally to thermally and physically poor mixing of the heavy oil in the reactor system and to the irregularity of the residence time. On the basis of this discovery and our recognition that the continuous liquid-phase production of pitch can be made possible by providing a suitable process and means for solving these problems, we have succeeded in developing this invention.

According to this invention in one aspect thereof, briefly summarized, there is provided a process for continuous production of pitch in which a heavy hydrocarbon oil is heat treated at a temperature in the range of 350° to 500° C successively in a plurality of reactors connected in series so that the liquid output of each reactor, exclusive of the final reactor, is supplied as input into the succeeding reactor, and at the same time, one portion of the liquid output substance from at least one reactor is recirculated into that reactor.

According to this invention in another aspect thereof, briefly summarized, there is provided a process for continuous production of pitch as set forth above which is followed by an after-treatment step in which the output substance of the final reactor is introduced into an after-treatment chamber of duct shape with an inactive atmosphere sealed therein thereby to cool the output substance.

The nature, utility, and further features of this invention will be more clearly apparent from the following detailed description beginning with a consideration of general aspects and features of the invention and concluding with a specific example of practice illustrating a preferred embodiment of the invention and a comparison example.

BRIEF DESCRIPTION OF THE DRAWING

In the accompanying drawing, the single FIGURE is a flow sheet illustrating one example of general organization of apparatus suitable for practicing the process for continuous production of pitch according to this invention.

DETAILED DESCRIPTION

In accordance with the process of the invention for producing pitch, by using a plurality of stages of reactors in series arrangement, the reaction conditions including the residence time of the heavy oil introduced into the reactor system are, as a whole, made as uniform as possible, and, also at the same time, in each of the reactors, thermally and physically uniform mixing is attained by the recirculation of the output substance from the reactor (the simple term "output substance" used hereinafter meaning a liquid output substance transformed into heavier oil or pitch and not containing gaseous-phase output substances).

By this practice, it is possible to reduce as much as possible the portions of the heavy oil remaining in the reactors in excess of the average residence time and becoming a cause of coking. Furthermore, by maintaining the residence time in each reactor within a specific range and, at the same time, increasing the flow rate in the vicinity of the outlet from the reactor where clogging tends to occur most readily by recirculating the output substance in each reactor, the changes of adhesion of the formed carbonaceous substances can be remarkably reduced.

The effectiveness of the use of the above mentioned multistage reactors in causing the reaction conditions to become uniform can also be substantiated theoretically as the effectiveness resulting from multistage division of a single complete mixing vessel. The properties of the product pitch produced by these multistage reactors are of a uniformity which cannot be obtained by a batch process.

More specifically, in the case where a heavy oil is subjected to heating treatment by a batch process, the starting material is introduced into the reactor as it is heated, or the total quantity of the starting material is charged into the reactor and is then gradually heated. However, by the former method, the difference in the heat treatment times existing between the starting material oil introduced initially and that introduced finally reaches a proportion which cannot be neglected in the total heat treatment time inclusive of the subsequent holding time. In the case of the latter method, also, the heat treatment in the temperature raising step reaches a proportion which cannot be neglected relative to the total heating treatment. In the latter case, furthermore, heating from the outside is inevitably required. Heating of the heavy oil in this manner from the outside gives rise to concentrated local heating, which becomes a major cause of inducement of coking.

In contrast, in accordance with the process of this invention, the heavy oil introduced into the reactor is uniformly mixed with the contents of the reactor in a relatively short time and it is subjected to heat treatment in a uniform time under uniform conditions within a range of residence time distribution throughout the entire reactor system. Furthermore, by increasing the number of reactors, the residence time distribution can be limited to a minimum width. This uniformization of the heating treatment conditions of the various portions of the heavy oil leads as a natural result to uniformization of the product pitch.

A further feature of this invention is that, in the case where the liquid output substance obtained in this manner from the final reactor is introduced into a duct-shaped after-treatment chamber with an inactive atmosphere sealed therewithin and is thus cooled, the high-temperature liquid output substance can be treated safely without interfering with the continuous operation of the entire process. At the same time, moreover, additional removal of volatile matter, if desired can be effected also in the duct-shaped after-treatment chamber, whereby the production of pitches of very high softening points and low volatile matter content becomes possible.

The process according to this invention will now be described in detail and with respect to specific quantitative values. It is to be understood that the details and values set forth below are presented as illustrative only and are not intended to limit the scope of this invention.

Referring to the accompanying drawing, the flow sheet shown therein indicates one example of organization of an apparatus system suitable for practicing the process for continuous production of pitch according to the invention. Starting material heavy oil is introduced through a line 1 by a pump 2 and sent to a heater 3, where it is heated to a temperature of 350° to 500° C. Preferably, into this flow of the heavy oil between the pump 2 and the heater 3, steam is introduced through a pipe line 4 at a flow rate of 0.1 to 5 percent, preferably 0.3 to 3 percent, by weight of the heavy oil in order to prevent coking in the heater 3.

Examples of suitable heavy hydrocarbon oils from which the starting material heavy oil may be selected are atmospheric distillation (topping) residue oils, vacuum distillation residue oils, residue oils of thermal cracking and catalytic cracking, deasphalting residue oils, natural asphalt, shale oil, and coal tar. Among these, those heavy hydrocarbon oils subtantially free from fractions boiling below 400° C, particularly 300° C, and having a density not lower than 0.9 and a carbon residue content (Conradson carbon) of not less than 5% by weight, are preferably used. For the heater 3, a known heater such as, for example, a tubular heating furnace as used in the delayed coking process can be used.

The heavy oil thus heated in the heater 3 is introduced into a first reactor 5 maintained at a specific temperature within a temperature range of 350° to 500° C, preferably 400° to 450° C. While the reactor 5 may be of any shape such as a drum, tower, or vertical or horizontal vessel, the preferred reactor is of a form of a tower or drum of vertically long shape of circular cross section having an externally concave dished bottom or an inverted conical bottom.

The reactor 5 is designed desirably with consideration being given to preventing the formation of dead volume. The liquid level within the reactor 5 can be maintained constant or appropriately varied in accordance with the character of the final product pitch with the aid of a level controller 9 provided e.g. at the side of the reactor. That is, it is desirable that the reactor 5 be operated in a state wherein a space is left at its upper part. For the level controller 9, any appropriate instrument suited for measurement of levels of liquids of high viscosity as, for example, a system for detecting and controlling the liquid level by means of a displacer type liquid level controller, a rotating viscosimeter, a gamma-ray densimeter, or the like can be used. The detection of the level can be accomplished continuously or at multiple points with respect to the height direction.

In the reactor 5, the heavy oil is retained for a specific time, during which thermal cracking, polymerization and condensation occurs. The gases and light oils formed by the cracking are taken out of the system through a condenser 10 together with the steam and the like introduced together with heavy oil. The reaction is ordinarily carried out under atmospheric pressure, but it is possible to appropriately adopt reduced pressure or elevated pressure with consideration of the quantity of the volatile matter within the product pitch, reaction conditions, and other factors since higher pressure conditions tend to suppress the cracking reaction and somewhat promote the polymerization and condensation.

One portion of the output substance from the reactor 5 is transferred directly by a pump 11 to a second reactor 14, while the remainder portion is recirculated by a pump 6 to the first reactor 5. It is preferable to install a heater 7 in the recirculation line downstream from the pump 6 for the purpose of replenishing the heat absorbed by the thermal cracking reaction and heat lost through the wall of the reactor 5. Furthermore, depending on the necessity, the load on the heater 3 can be reduced thereby. In this case, the introduction of steam at a flow rate of 0.1 to 5 percent by weight, preferably 0.3 to 3 percent by weight of the recirculated output substance at a point upstream from the heater 7 is preferable similarly as in the case of the heater 3.

By recirculating a portion of the output substance of the reactor 5 in this manner, an effect of uniformizing the physical and thermal mixing of the substances within reactor can be attained. The flow rate of this recirculation R[$m^3$/hour or $m^3$/minute] is preferably such that the V/R will become one hour or less, particularly from 5 to 30 minutes wherein V[$m^3$] denotes the retention volume (the volume of the contents) of the reactor. While a high recirculation flow rate is desirable for its mixing effect, its upper limit is determined for reasons of economy. This recirculation flow rate can be controlled by using metering pumps for the recirculation pump 6 and the transfer pump 11 or by adopting a system wherein control valves are installed in respective flow lines. Alternately, it is also possible to use a system wherein one pump is used for the two pumps and a control valve is installed in at least one flow line, for example, in only the recirculation line.

The uniformization of the reaction conditions within the reactor is of particular importance in the practice of this invention. Accordingly, it is desirable, in order to increase the uniformization effect, to use means such as an agitator and a pipe 12 inserted into the reactor 5 to a point near the bottom thereof to introduce steam, or an inactive gas such as nitrogen, or a hydrocarbon. When a pipe 12 is used, its mixing effect can be increased by providing numerous holes in its wall below the level of the liquid in the reactor 5. Of the above mentioned auxiliary means for uniformization, means for introducing an inactive gas, which does not greatly increase the dead volume of does not become an object onto which formed carbonaceous substances can adhere, is preferable.

However, a considerable number of pipes must be used in order to distribute the inactive gas uniformly throughout the interior of the reactor. Furthermore, an auxiliary means of this character is not very effective in its mixing action in the vicinity of the discharge outlet of the reactor where the possibility of clogging by carbon adhesion is the greatest. Accordingly, the recirculation of the reactor output substance according to this invention has a substantial function in the operation thereof. Furthermore, in some instances depending on the kind of the starting material heavy oil and the reaction conditions, the operation becomes difficult because of foaming of the liquid within the reactor, particularly when an inactive gas is blown in as described above. In such instances, an antifoaming or defoaming agent such as methyl polysiloxane or dimethyl polysiloxane is injected into the reactor either intermittently or continuously at a low flow rate through a nozzle 13.

The output substance transferred by the pump 11 from the first reactor 5 to the second reactor 14, while having been made heavier relative to the starting material heavy oil as a result of the heat treatment in the first reactor 5, is further transformed into a heavier oil by heat treatment in the second reactor 14. The parts 14 through 22 of and associated with this second reactor 14 respectively correspond and are similar to the parts 5 through 13 of and associated with the first reactor 5. The organization and operation of the second reactor 14 are essentially the same as those of the first reactor and, therefore, will not be described.

The output substance from the second reactor 14 is further sent successively through additional reactors (third, fourth, . . .) when necessary for further transformation into a heavier oil. In this connection, an increase in the number of reactors results in a narrowing of the residence time distribution of the passed heavy oils throughout the entire reactor system and is desirable also from the viewpoint of the operation for the purpose of uniformization of the quality of the product pitch. The upper limit to the number of reactors is determined by the economy of the operation, being ten, in general, and the number is ordinarily selected within the range of 2 to 5.

The reaction conditions of all reactors are not necessarily the same. For example, the reaction temperatures and average residence times of the various vessels can be appropriately varied with the use and characteristics of the product pitch being taken into consideration. In this sense also, the process of this invention, in which several reactors are used, and the residence times can be varied by adjusting the liquid levels in the reactors, in desirable.

In addition, the reaction temperatures of the reactors are suitably selected in the range of 350° to 500° C, preferably 400° to 450° C, in conformance with the use of the product pitch and the state of the reaction. In general, however, conditions such that the reaction temperatures will be substantially the same throughout the entire reaction system or will be of a distribution wherein the temperature becomes higher in the succeeding reactors in order to obtain pitch of low content of volatile matter, for example, are desirable. Furthermore, while the average residence time throughout the entire reactor system differs with the reaction temperatures, it is selected in a range of 10 minutes to 30 hours, preferably 10 minutes to 2 hours.

In the foregoing disclosure, this invention was described with respect to the case wherein the recirculation of the output substance is carried out in each reactor. This recirculation, however, is not absolutely necessary in all reactors. The reason for this is that, since the reaction for producing pitch from heavy oil in the process of this invention is carried out in a plurality of reactors connected in series, the degree of transformation into a heavier oil in a reactor of one stage can be moderated. Particularly since the degree of transformation into a heavier oil is lower and the content of volatile matter remains in a relatively large quantity in an upstream reactor, the viscosity of the contents of the reactor is relatively low, and the reaction conditions are eased. Accordingly, the possibility of coking and clogging of the outlet part can be reduced. Therefore, in the process of this invention, recirculation of the output substance is carried out in at least one reactor in which the reaction for transformation into a heavier oil is to be promoted to a high degree.

Furthermore, in a downstream reactor, even if the reaction, itself, for transformation into a heavier oil is gentle (a high temperature being used according to necessity also for compensating for the lowering of the reaction rate), the contents have been transformed into a heavier oil as a result of the upstream reaction, and, therefore, it is desirable to resort to recirculation of the output substance. Particularly in the case where transformation into a heavier oil and removal of the volatile matter content in the most downstream reactor in order to obtain a pitch of low content of volatile matter, the recirculation of the output substance at this most downstream reactor is desirable. However, since the recirculation of the output substance is desirable in any of the reactors for safe practice of the process of this invention, it is preferably carried out with respect to all reactors within limits permitted by economy.

The molten pitch produced from the reaction system in the above described manner is discharged out of the system by the output pump of the last reactor (the pump 20 of the second reactor 14 in the illustrated example) and is cooled by a suitable method, whereupon it becomes the product pitch. Examples of methods for this cooling are the method wherein the molten pitch is caused to flow into water thereby to be cooled and to harden and the method wherein the molten pitch is caused to flow into a receiving vessel and is then quenched by a coolant such as water.

However, the molten pitch produced from a reaction system, in general, is at a temperature above 400° C and, moreover, is smoking, and taking this pitch as it is out into the atmosphere is not desirable for the sake of environmental hygiene and safety. Furthermore, methods in which ordinary cooling pipes and cooling vessels are used are not desirable since hardening and clogging tend to arise and have an adverse effect on also the reaction system. Moveover, while the above mentioned method of causing the pitch to flow into water is suitable for pitch of low softening point and high succeptibility, it cannot be said to be generally satisfactory.

In view of the above described problems, this invention in a second aspect thereof further provides a desirable process for after treatment of the molten pitch produced in the above described manner.

More specifically, the molten pitch taken out of the final reactor of the above described reaction system through the output pump (pump 20 for the second reactor 14 in the illustrated example) is introduced into an after treatment chamber 23 of duct shape sealed with an inactive atmosphere, where it is cooled and hardened. By the term "after treatment chamber of duct shape" (hereinafter referred to simply as "chamber") is meant a chamber which has, at approximately its two ends in its direction of extension, an entrance and an exit for receiving vessels and, at the same time has a pitch introducing section at its middle part, and which is so adapted that pitch can travel in the extension direction thereof in the receiving vessels. While the extension direction of the chamber is horizontal, in general, it may be inclined or vertical.

In the illustrated example, a series or train of receiving vessels 24 is introduced into a chamber 23 through an entrance 25 at one end thereof and is caused by a conveyer or a driving mechanism (not shown) to travel continuously or intermittently at a specific speed through the interior of the chamber 23. The entrance section is provided with means including double shutters 26 and 27 adapted to open and close alternately thereby to permit the entrance of the receiving vessels 24 without opening the interior of the chamber to the outside atmosphere. Instead of the double shutter device, seals of inactive gases such as nitrogen, carbon dioxide, and combustion exhaust gas or a water seal can be used. These sealing means may be used in combination.

While traveling along the interior of the chamber 23, the receiving vessels 24 successively receive molten pitch and travel along the interior of the chamber 23 as the pitch in these receiving vessels 24 are successively subjected to separation of generated gas from the pitch by an exhaust fan 28, cooling by means 29 supplying cooling air, and cooling by means 30 supplying cooling water. Then each receiving vessel 24 is loaded onto a lowering-lifting platform 32 capable of traveling horizontally in the lowered state and is submerged and moved through a water bath 31, being thereafter taken together with the cooled and hardened pitch out of the water bath 31 at the right-hand side thereof as viewed in the drawing. For this operation, it is advantageous to line the receiving vessels 24 beforehand with a heat-resistant sheet such as aluminum foil thereby to facilitate the separation and removal of the pitch from the receiving vessels 24 after hardening. By this expedient, the product pitch can be collected without the use of any special device or motive power whatsoever.

Instead of the above described combination of receiving vessels 24, a conveyer, etc., a traveling floor which is continuous in the extension direction of the chamber 23 may be used. Furthermore, the combination of the water bath 31 and the lowering-lifting platform 32, constituting a water seal, is not indispensable. Provided that the chamber 23 is amply long, the necessary sealing effect of the high-temperature section (in the vicinity of the station where molten pitch is poured into the receiving vessels 24) can attained without using this combination.

In addition, by providing the high-temperature section of the chamber 23 with an amply thermally insulative construction, providing an auxiliary heat source therein if necessary, and, moreover, increasing the residence time within the chamber 23, a substantial effect of removal of volatile matter in the pitch can be attained. By these measures, economical continuous production of pitch of low content of volatile matter and high softening point (for example, a volatile component of less than 20 percent, or a pitch of a character close to that of raw coke), which cannot be obtained by a treatment in a system of only reactors, becomes possible. Still another possible modification is the use of an ejector or a vacuum pump instead of, or together with, the exhaust fan 28 thereby to place the high-temperature section within the chamber 23 in a reduced pressure state. By a method such as this, the effect of removing volatile matter can be increased.

The above described features and other features of the continuous process for producing pitch according to this invention may be summarized as follows.

1. Continuous production of pitch by a liquid-phase process is made possible by an apparatus system of relatively simple construction based on a multiple reactor system.

2. Since continuous production is attained as stated above, the problems of coking and of clogging due to adhesion of formed heavy carbonaceous matter to the reactor wall, the reactor outlet, and like parts, which problems have heretofore been an obstruction to continuous production, are solved by the thermal and physical uniformization in each of the plural reactors and throughout the entire reactor system. At the same time, this makes possible the uniformization of the quality of the product pitch.

3. By diversification of control factors, adjustments of the reaction conditions such as temperature, average residence time, and pressure in each reactor are possible, whereby it is possible to produce pitches of properties fulfilling a wide range of requirements. At the same time, a substantial stabilization of the product quality is achieved.

4. Since a duct-shaped chamber is used for processing molten pitch, the step of taking out the pitch can be carried out safely and efficiently, and a consistent, continuous pitch producing process becomes possible. Furthermore, by increasing the thermal insulation of the high-temperature section of the chamber and/or carrying out auxiliary heating or pressure reduction thereof in accordance with necessity, pitches of low volatile content and ultra-hard character can be produced.

In order to indicate still more fully the nature and utility of this invention, the following specific examples of practice constituting preferred embodiments of the invention and a comparison example are set forth, it being understood that the former examples are presented as illustrative only and are not intended to limit the scope of the invention.

EXAMPLE 1

The process of this invention was carried out with the use of an apparatus of the organization shown in the accompanying flow sheet except that only the after-treatment chamber 23 was repladed by a sealed chamber having therewithin a receiving vessel for cooled pitch.

Residual oil from vacuum distillation of Arabian-light crude oil (residual carbon content 16.5 percent by weight, softening point 45° C, benzene insoluble component 0 percent, C/H atomic ratio 0.6) was used as the starting material, being supplied at a rate of 12 Kg./hour by a pump 2 into a heater 3. Water was introduced at a rate of 250 g./hour through a branch pipe 4 on the upstream side of the heater 3. The temperature of the oil at the outlet of the heater 3 was adjusted to 430° C, and this oil was introduced into a first reactor 5 (of cylindrical shape of 150-mm. inner diameter and 370-mm. height) through the top thereof.

In the reactor 5, the temperature of the contents was regulated and maintained at 430° C by salt bath heating and circulation heating, and the liquid retention volume was maintained at 2 liters by means of a displacer type liquid level controller 9. One portion of the output substance discharged from the bottom of the reactor 5 was recirculated to the top of the reactor 5 at a rate of 12 Kg/hour as it was reheated. At the same time, the contents of the reactor 5 were agitated by injecting nitrogen gas at a rate of 30 Nl/hour through a pipe 12 inserted through the center of the top of the reactor to a point near the bottom thereof.

Gases and distillates of light oil fraction were taken out through the top of the first reactor 5 by a water-cooled condenser 10. From the bottom of the reactor 5, a pitch-like formed substance was sent by a transfer pump 11 to a second reactor 14 of essentially the same construction as the first reactor 5, where the substance was further treated under the same conditions and procedure as in the first reactor 5.

The output substance obtained through the bottom of the second reactor 14 was pumped by a pump 20 at an average rate of 5.2 Kg/hour into the pitch receiving vessel in the sealed chamber and was taken out and cooled. The pitch obtained was found to have properties as set forth in the following table and had characteristics suitable for numerous practical uses such as that as a binder, that as a compounding agent for road paving, and that as a oil adsorbent.

A satisfactory continuous operation was possible under the above described conditions.

Table 1

| Substances produced in the Example | | Method of measurement |
|---|---|---|
| PITCH | | |
| Pitch yield (Wt.%) | 43.0 | — |
| Softening point (° C) | 137 | *JIS. K2425 (ring & ball) |
| Volatile matter (Wt.%) content | 58.9 | JIS. K8812 |
| Fixed carbon content (Wt.%) | 52.8 | JIS. K2425 |
| Benzene insoluble (Wt.%) content in benzene | 26.8 | JIS. K2425 (basis) |
| Quinoline insoluble (Wt.%) content | 5.1 | JIS. K2425 (basis) |

Table 1-continued

| Substances produced in the Example | | Method of measurement |
|---|---|---|
| C/H atomic ratio | 1.06 | Yanagimoto CHN coder |
| Specific gravity 15/4° C | 1.25 | |
| CRACKED OIL | | |
| Cracked oil yield (Wt.%) | 49.2 | — |
| Specific gravity 15/4° C | 0.8501 | JIS. K2249 |
| Viscosity at 50° C (cst) | 3.65 | JIS. K2283 |
| CRACKED GAS | | |
| Cracked gas yield (Wt.%) | 7.8 | — |
| Gas composition | | |
| methane (Wt.%) | 20.4 | Gas chromatography |
| ethane (Wt.%) | 23.4 | Gas chromatography |
| propane (Wt.%) | 16.9 | Gas chromatography |
| propylene (Wt.%) | 8.2 | Gas chromatography |

NOTE:
designates Japanese Industrial Standards

COMPARISON EXAMPLE

The procedure set forth in the foregoing Example was followed except that the second reactor was not used, the retention volume of the contents of the first reactor, instead, being maintained at 4 liters, and the residence time within the reactor was adjusted to equal the total residence time of the foregoing Example.

Approximately 20 minutes after the start of the operation, the bottom part and the outlet pipe part of the reactor became clogged because of coking. Accordingly, the operation was carried out under variously changed operational conditions. As a result, it was concluded that the necessary conditions for making continuous operation possible are a maintained retention volume of approximately 2.5 liters or less at a reactor temperature of 430° C.

Therefore, the operation was carried out at a maintained volume of 2.5 liters, whereupon the output flow rate became approximately 9 Kg./hour, and a pitch of a softening point of 55° C and a low degree of heat treatment indicated by a volatile matter content of 80 percent by weight was obtained.

The results of the foregoing Example 1 and the above described Comparison Example 1 clearly indicate the utility of this invention which is characterized by the use of two or more reactors instead of a single reactor and of the recirculation of one portion of output substances of at least one of the reactors.

EXAMPLES 2 AND 3

The operation of Example 1 was repeated with reactors 5 and 14 of a larger volume (cylindrical shape of 30 mm. inner diameter and 680 mm. height).

The operation conditions and the properties of the products are summarized in Tables 2 and 3 below.

Table 2

| Operation Conditions for Examples 2 and 3 | | Example No. 2 | 3 |
|---|---|---|---|
| Item* | | | |
| Feed rate (2) (kg/hour) | | 67 | 34 |
| Steam charge rate (4) (kg/hour) | | 0.48 | 0.468 |
| Heater (3) outlet temperature (° C) | | 435 | 423 |
| First reactor (5) | Retention volume (1) | 15 | 15 |
| | Temperature (° C) | 430 | 401 |
| | Recirculation rate (6) (kg/hour) | 180 | 90 |
| | Steam charge rate (8) (kg/hour) | — | 6 |
| | Nitrogen injection rate (12) (Nl/hour) | 90 | — |
| Second reactor | Retention volume (1) | 15 | 15 |
| | Temperature (° C) | 430 | 365 |
| | Recirculation rate (15)(kg/hour) | 180 | 90 |
| | Steam charge rate (17) (kg/hour) | — | 6 |
| | Nitrogen injection rate (21) | 90 | — |

*The numerals shown in the parentheses correspond to those used in the accompanying drawing.

Table 3

| Properties of the products | Ex. No. 2 | 3 | Commercially available pitch |
|---|---|---|---|
| Item | | | |
| PITCH | | | |
| Pitch yield (Wt.%) | 35.8 | 57.1 | — |
| Softening point (° C) | >200 | 98.5 | 97.5 |
| Volatile matter content (Wt.%) | 2.4 | 74.0 | 56.1 |
| Fixed carbon content (Wt.%) | 58.6 | — | — |
| Benzene insoluble content (Wt.%) | 41.9 | 5.4 | 35.4 |
| Quinoline insoluble content (Wt.%) | 17.5 | 0.9 | 13.2 |
| C/H atomic ratio | 1.16 | — | — |
| Specific gravity 15/4° C | 1.27 | — | — |
| Binder Effect (kg/cm²) | | 64 | 48 |
| CRACKED OIL | | | |
| Yield (Wt.%) | 55.1 | | |
| Specific gravity 15/4° C | 0.8623 | | |
| Viscosity at 50° C (CST) | 4.35 | | |
| CRACKED GAS | | | |
| Yield (Wt.%) | 9.1 | | |
| Composition | | | |
| methane (wt.%) | 22.6 | | |
| ethane (wt.%) | 20.4 | | |
| neopane (wt.%) | 16.2 | | |
| propylene (wt.%) | 7.4 | | |

*Binder effect was measured according to the following procedure.

MEASUREMENT OF BINDER EFFECT

The product pitch of Example 3 above and a commercially available pitch having properties listed in Table 3 above were respectively used as a binder for producing formed coal as follows.

(Starting coal composition)

Weak coking coal (Miike coal): 60 wt. %
Non-coking coal (Taiheiyo coal): 30 wt. %
Petroleum coke: 10 wt. %

91 parts by weight of the starting coal mixture of the above composition crushed to a particle size of less than 3 mm. was mixed with the pitch at a temperature of 20° C above the softening point of the pitch, and the mixture was formed under a pressure of 250 kg/cm² into formed coal of the size of 30 mm in diameter and 25 mm. in length.

The compression crushing strength of the formed coal thus obtained is listed as "binder effect" in Table 3 above for each pitch.

From the crushing strength data shown in Table 3, it would be apparent that a pitch suitable as a coal binder can be produced by the process of this invention.

We claim:

1. A process for continuous production of pitch which comprises heat treating a heavy hydrocarbon oil at a temperature in the range of 350° to 500° C successively in a plurality of reactors connected in series arrangement and at the same time, recirculating one portion of the liquid output substance from at least one reactor of said plurality of reactors into said at least one reactor.

2. A process for continuous production of pitch as claimed in claim 1 in which one portion of the liquid output substance from each of said plurality of reactors is recirculated into that reactor.

3. A process for continuous production of pitch as claimed in claim 1 in which said one portion of the liquid output substance from said at least one reactor is thus recirculated into said reactor after being reheated.

4. A process for continuous production of pitch as claimed in claim 1 in which the heavy hydrocarbon oil is first introduced into a heater together with steam supplied at a rate of 0.1 to 5 percent by weight of the heavy hydrocarbon oil, and is thus preheated to a temperature of 350° to 500° C prior to being introduced into the first reactor.

5. A process for continuous production of pitch as claimed in claim 1 further comprising an after-treatment step of introducing the output substance from the final reactor into an after-treatment chamber of duct shape with an inactive atmosphere sealed therein thereby to cool said output substance.

6. A process for continuous production of pitch as claimed in claim 5 in which, in the after-treatment step, the output substance is introduced into the after-treatment chamber at a part thereof which, together with the vicinity thereof, is maintained at a constant temperature, heating being resorted to if necessary for this purpose.

7. A process for continuous production of pitch as claimed in claim 5 in which the interior of the after-treatment chamber is maintained under reduced pressure during the process.

8. A process for continuous production of pitch as claimed in claim 1 in which the heavy hydrocarbon oil is a member selected from the group consisting of atmospheric distillation residue oils, vacuum distillation residue oils, residue oils of thermal cracking and catalytic cracking, deasphalting residue oils, natural asphalts, shale oil, coal tars, and mixtures thereof.

9. A process for continuous production of pitch as claimed in claim 5 in which the heavy hydrocarbon oil is a member selected from the group consisting of atmospheric distillation residue oils, vacuum distillation residue oils, residue oils of thermal cracking and catalytic cracking, deasphalting residue oils, natural asphalts, shale oil, coal tars, and mixtures thereof.

10. A process for continuous production of pitch as claimed in claim 1 in which the temperatures within the reactors are maintained within the range of 400° to 450° C.

11. A process for continuous production of pitch as claimed in claim 5 in which the temperature within at least the first reactor is maintained within the range of 400° to 450° C.

12. A process for continuous production of pitch as claimed in claim 4 in which the steam is supplied at a rate of 0.3 to 3 percent by weight of the heavy hydrocarbon oil.

13. A process as claimed in claim 1 in which the recirculation flow rate R is such that the value V/R will become 1 hour or less wherein V denotes the retention volume of said at least one reactor.

14. A process as claimed in claim 13 in which said value V/R is set within the range of from 5 to 30 minutes.

* * * * *

UNITED STATES PATENT AND TRADEMARK OFFICE

CERTIFICATE OF CORRECTION

PATENT NO. : 4,080,283

DATED : March 21, 1978

INVENTOR(S) : Kosaku Noguchi et al.

It is certified that error appears in the above-identified patent and that said Letters Patent are hereby corrected as shown below:

The name of co-patentee "Tanaki" should be -- Tanaka --.

Signed and Sealed this

*Nineteenth* Day of *September 1978*

[SEAL]

*Attest:*

RUTH C. MASON
*Attesting Officer*

DONALD W. BANNER
*Commissioner of Patents and Trademarks*